US006942705B2

(12) United States Patent
Inoue et al.

(10) Patent No.: US 6,942,705 B2
(45) Date of Patent: Sep. 13, 2005

(54) METHOD OF DYEING THERMOPLASTIC RESIN ARTICLE AND COLORED PLASTIC LENS OBTAINABLE BY THAT METHOD

(75) Inventors: Kazuo Inoue, Tokyo (JP); Misa Mishna, Tokyo (JP); Masahiro Nakagawa, Tokyo (JP)

(73) Assignee: Hoya Corporation, Tokyo (JP)

( * ) Notice: Subject to any disclaimer, the term of this patent is extended or adjusted under 35 U.S.C. 154(b) by 231 days.

(21) Appl. No.: 10/392,875

(22) Filed: Mar. 21, 2003

(65) Prior Publication Data

US 2003/0182737 A1 Oct. 2, 2003

(30) Foreign Application Priority Data

Mar. 29, 2002 (JP) ..... 2002-094258

(51) Int. Cl.[7] ..... D06P 1/92
(52) U.S. Cl. ..... 8/506; 8/512; 8/617
(58) Field of Search ..... 8/506, 512, 513, 8/617

(56) References Cited

U.S. PATENT DOCUMENTS

| | | | | | |
|---|---|---|---|---|---|
| 4,377,389 | A | * | 3/1983 | Haddad et al. | 8/506 |
| 5,092,907 | A | | 3/1992 | Riblet et al. | |
| 5,509,940 | A | * | 4/1996 | Zbar et al. | 8/617 |

FOREIGN PATENT DOCUMENTS

| | | |
|---|---|---|
| GB | 791 392 | 3/1958 |
| JP | 04-057980 | 2/1992 |
| JP | 04-1464278 | 5/1992 |
| JP | 09-145901 | 6/1997 |
| JP | 11-248901 | 9/1999 |
| JP | 2000-248475 | 9/2000 |
| JP | 2001-192985 | 7/2001 |

* cited by examiner

*Primary Examiner*—Margaret Einsmann
(74) *Attorney, Agent, or Firm*—Morrison & Foerster LLP

(57) ABSTRACT

The invention provides a method of effectively dyeing a thermoplastic resin plastic lens in any desired color tone and density as well as a colored plastic lens made by the method. The method involves dipping a thermoplastic resin plastic lens in a dyeing liquid containing one or more disperse dyes and one or more monocyclic monoterpenes.

16 Claims, No Drawings

METHOD OF DYEING THERMOPLASTIC RESIN ARTICLE AND COLORED PLASTIC LENS OBTAINABLE BY THAT METHOD

BACKGROUND OF THE INVENTION

1. Technical Field

This invention relates to a method of dyeing a thermoplastic resin article, especially a thermoplastic resin plastic lens, and to a colored plastic lens obtainable by that method. More specifically, the invention relates to a method of dyeing a thermoplastic resin article which can effectively dye the article at a low temperature within a short period of time, and to a colored plastic lens obtained by that method.

2. Description of the Related Art

Cast polymerization or injection molding is usually employed for molding plastic lenses, especially spectacle lenses. A polycarbonate comprising bisphenol A is known as a raw material for molding lenses by injection molding. When a polycarbonate comprising bisphenol A is used as the raw material, the manufacturing time of lenses can be shortened, and good impact resistance can be imparted. Accordingly, a number of thermoplastic lenses obtained by injection molding have been proposed.

Generally employed methods of dyeing plastic lenses include dyeing with one or more disperse dyes using water as a dispersion medium. Further, in the case of plastic lenses that are difficult to dye with disperse dyes using water as the dispersion medium, it has been proposed to use carrier dyeing, in which trichlorobenzene or the like is added to the dyeing liquid, pressure dyeing, a method in which an organic dye is heated and sublimated in a vapor phase to achieve dyeing, and hardcoat film dyeing.

However, thermoplastic resins such as polycarbonates comprising bisphenol A are highly hydrophobic. Therefore, it is difficult to perform dyeing with a disperse dye, particularly high-density dyeing, with these usual dyeing techniques.

Where the above-described various conventional dyeing methods are employed for making thermoplastic resin plastic lenses, the art encountered the following problems.

In dyeing with a disperse dye using water as a dispersion medium, it is necessary to perform the dyeing at a relatively high temperature. Accordingly, it is difficult to apply this dyeing technique to thermoplastic resin plastic lenses having a low glass transition temperature.

In carrier dyeing, thermoplastic resins are inferior to thermosetting resins in resistance to solvents. Accordingly, the carrier materials generally used in optical plastic lenses can invade the lens surface so that the necessary degree of transparency may be lost. Further, conventional carriers can contain, as a major component, trichlorobenzene, dichlorobenzene, phenylphenol, diphenyl, methylnaphthalene, or the like. These compounds are considered to be potentially damaging to the environment or to adversely affect human health. Thus, when these environmental and health problems are taken into consideration, carrier materials containing such compounds as major components are considered undesirable for future use.

The pressure applied in pressure dyeing may damage or destroy the optical performance qualities of plastic lenses.

The method in which an organic dye is heated and sublimated in a vapor phase to achieve dyeing is difficult to apply to thermoplastic resins, since such resins are generally inferior in heat resistance.

In hardcoat film dyeing, since it is difficult to put a large amount of a dye in a hard film, it is difficult to achieve high-density dyeing. In the case where the film thickness is made thick in order to contain a large amount of dye, problems such as crack generation in the hardcoat film may distort the lens shape, and film hardness may become low Moreover, the light resistance provided by hardcoat dyeing is poor as compared with methods in which the dye is directly applied to or incorporated in the thermoplastic resin substrate.

In the method in which a dye is dissolved in the raw material (monomer or monomer mixture) of the plastic lens substrate and then polymerized, the coloring density of the formed lens depends upon the thickness of the lens. For example, in concave lenses in which the central portion of the lens is thinner than the surrounding thereof, the color of the central portion of a lens made by this method is paler than the color of the surrounding portions. For this reason, there is a possibility that the color density varies considerably over the whole of the lens. Also, in lenses for spectacles having a different diopter from each other, there is a possibility that the color density is different between the left and right lenses. It is practically impossible to manufacture colored optical plastic lenses of a number of varieties while preparing a number of raw material liquids having varied color tones and densities depending upon the market needs, so this problem is particularly troublesome.

In addition, methods in which compounds having a number of dyeing sites are added to a substrate for the purpose of improving dyeability cannot be put into practical use because when these compounds are compounded in the substrate, the abrasion resistance and transparency of the substrate are lowered.

SUMMARY OF THE INVENTION

In view of these disadvantages of prior dyeing techniques, this invention provides a method for dyeing a thermoplastic resin, especially a thermoplastic resin plastic lens, which is capable of effectively dyeing a thermoplastic resin containing a polycarbonate resin comprising bisphenol A, which is difficult to dye with conventional dyeing methods, and is also capable of effectively dyeing a thermoplastic resin, especially plastic lenses containing a polyester resin, which can be dyed by conventional dyeing methods, but at a lower temperature for a short period of time than the conventional methods. The invention also includes the colored plastic lenses obtained by these methods.

We have found that this result can be achieved by dyeing a thermoplastic resin made of a polycarbonate resin as a raw material, which is difficult to dye by conventional methods, or a thermoplastic resin made of a polyester resin as a raw material, which is dyeable by such conventional methods but is low in heat resistance, with a mixture of a disperse dye or dyes and a monocyclic monoterpene or a mixture of monocyclic terpenes.

Specifically, the invention provides a method of dyeing a thermoplastic resin, which comprises dipping a thermoplastic resin in a dyeing liquid containing one or more disperse dyes and one or more monocyclic monoterpenes, and the colored plastic lens obtained by that dyeing method. By using the method of the invention, a thermoplastic resin optical plastic lens that is difficult to dye can be dyed in arbitrary color tones and density levels with extremely good efficiency at a low temperature for a short period of time by using a disperse dye and a monocyclic monoterpene. Thus, colored plastic lenses suitable as high-fashion spectacle lenses can be cheaply manufactured, with improved abrasion resistance and transparency Further, since the monocyclic monoterpenes used in this invention have good biodegradation properties, there is no fear of environmental pollution or adverse impact on human health.

DETAILED DESCRIPTION OF THE INVENTION

In the method of dyeing a thermoplastic resin article according to the invention, a thermoplastic resin article is dipped in a dyeing liquid containing one or more disperse dyes and one or more monocyclic monoterpenes.

The thermoplastic resin article may be a molded article, especially a thermoplastic resin plastic lens, however the thermoplastic resin is not limited to a thermoplastic resin plastic lens or any other particular type of thermoplastic resin article, since the method of this invention has generally applicability regardless of the use to which the thermoplastic resin article is to be put.

The thermoplastic resin plastic lens may be any of a variety of plastic lenses made of a raw material that can be subjected to injection molding. For example, plastic lenses containing a thermoplastic resin that is difficult to dye by conventional dyeing means, such as polycarbonate resins and polyolefin resins; plastic lenses containing a thermoplastic resin that is dyeable by such conventional dyeing methods, such as polyester resins; and lenses containing a raw material comprising at least one member selected from polymer alloys comprising the foregoing resins, can be used.

The polycarbonate resins may be any polycarbonate resins that can be used for lenses without particular limitations. Examples include polymers or copolymers obtained by the phosgene process for reacting a varied dihydroxydiaryl compound with phosgene, or the ester exchange process for reacting a dihydroxydiaryl compound with a carboxylic ester such as diphenyl carbonate. Representative examples include polycarbonate resins produced by using 2,2-bis(4-hydroxyphenyl)propane (bisphenol A) as the dihydroxydiaryl compound.

The polyolefin resins may be any polyolefin resins that can be used for lenses without particular limitations. Examples include amorphous, dicyclopentadiene-based cycloolefin polymers such as ZEONOR, trade name of Zeon Corporation; ARTON, trade name of JSR Corporation; and TOPAS, trade name of Mitsui Chemicals, Inc.

The polyester resins may be any polyester resins that can be used for lenses without particular limitations. Examples include glycol-modified polyethylene terephthalates (such as EASTAR DN003, manufactured by Eastman Chemical Company).

The polymer alloys useful in this invention include without particular limitation commercially available alloys of a polycarbonate resin and a polyolefin resin, alloys of a polyolefin resin and the foregoing polyester resin, and alloys of a polycarbonate resin and a polyester resin. Examples include XYLEX (trade name of GE Plastics Japan) and EASTALLOY DA003 (trade name of Eastman Chemical Company).

In the method according to the invention, a disperse dye is used as the dye. Although the disperse dye is sparingly soluble in water, it is partially dissolved and dispersed into the inside of the lens, thus dyeing the plastic lens. Examples of this type of dye include azo-based dyes, anthraquinone-based dyes, and nitroallylamine-based dyes. The azo-based and nitroallylamine-based dyes are mainly of a yellow, orange, or red system, and the anthraquinone-based dyes are chiefly of a blue or violet system.

Representative examples of the disperse dyes that can be used in the method according to the invention include:

(1) Blue dyes: Dianix Blue AC-E, Dianix Blue RNE (C.I. Disperse Blue 91), Dianix Blue GRE (C.I. Disperse Blue 81), Sumikaron Blue E-R (C.I. Disperse Blue 91), Kayalon Polyester Blue GR-E (C.I. Disperse Blue 81);

(2) Red dyes: Dianix Red AC-E, Diacelliton Fast Red R (C.I. Disperse Red 17), Diacelliton Fast Scarlet R (C.I. Disperse Red 7), Diacelliton Fast Pink R (C.I. Disperse Red 4), Sumikaron Rubine SE-RPD, Kayalon Polyester Rubine GL-SE200 (C.I. Disperse Red 73);

(3) Yellow dyes: Dianix Yellow AC-E, Dianix Yellow YL-SE (C.I. Disperse Yellow 42), Sumikaron Yellow SE-RPD, Diacelliton Fast Yellow GL (C.I. Disperse Yellow 33), Kayalon Fast Yellow GL (C.I. Disperse Yellow 33), Kayalon Microester Yellow AQ-LE;

(4) Orange dyes: Dianix Orange B-SE200 (C.I. Disperse Orange 13), Diacelliton Fast Orange GL (C.I. Disperse Orange 3), Miketon Polyester Orange B (C.I. Disperse Orange 13), Sumikaron Orange SE-RPD, Sumikaron Orange SE-B (C.I. Disperse Orange 13); and (5) Violet dyes: Dianix Violet SR-SE (C.I. Disperse Violet 56), Sumikaron Violet E-2RL (C.I. Disperse Violet 28)

In the method of the invention, the monocyclic monoterpene that is used together with the disperse dye includes limonene, menthol, terpinene, phellandrene, sylvestrene, pinene, and terpineol and mixtures of these monoterpenes. Persons skilled in the art will appreciate that other monoterpenes or mixtures thereof may be used based on routine testing of such monoterpenes. For example, commercially available water-soluble cleaning agents containing limonene may be used. Further, the monocyclic monoterpene may be emulsified using one or more anionic surfactants such as alkylbenzenesulfonates, alkylnaphthalenesulfonates, alkylsulfosuccinates, aromatic sulfonic acid-formalin condensates, and lauryl sulfonates, or one or more nonionic surfactants such as polyoxyethylalkyl ethers, alkylamine ethers, and polyoxyethylene sorbitan fatty acid esters, and dispersed in the dyeing bath.

In the method according to the invention, the ratio of the disperse dye to the monocyclic monoterpene or monoterpene mixture to be used in the dyeing liquid is not particularly limited but may be properly chosen depending on the kind of plastic lens to be dyed and the disperse dye or dyes selected.

Similarly, the amount of the disperse dye to be added in the dyeing liquid is not particularly limited. However, as a matter of practical use, the amount of dye used is preferably from about 0.1% to about 5% by weight, and more preferably from about 0.3% to about 0.5% by weight of the whole amount of the dyeing liquid.

The amount of the monocyclic monoterpene or monoterpene mixture to be added in the dyeing liquid is not particularly limited. However, again as a matter of practical use, it is preferably from 0.001 to 1% by weight, and more preferably from about 0. 01% to about 0.5% by weight of the whole amount of the dyeing liquid.

Further, in the case of half-dyeing, there is the possibility that during moving the lens up and down at the time of dyeing, the dye attaches to the lens surface, dries and adheres thereto. In this case, in order to prevent unwanted adhesion of the dye, a large quantity of surfactant may be added to the dyeing liquid. Doing this produces a good emulsification state of the monocyclic monoterpene, thereby preventing the dye from adhering to the lens. The surfactant used in this half-dyeing application is not particularly limited, but conventionally known ones may be used. In particular, those having a polyoxyethylene structure are preferable. The weight of the surfactant to be added in the dyeing liquid during the half-dyeing is not particularly limited but is preferably from 1.1 to 2 times that used when dyeing the entire article or lens.

In dyeing a thermoplastic resin plastic lens by the method of the invention, a dye dispersion bath is first prepared. In the dye dispersion bath, predetermined amounts of the disperse dye or dyes and the monocyclic monoterpene or monoterpene mixture are added to water, for example, so that the dye density is from about 0.1% to about 5% by weight. In addition, if desired, a known dispersing agent that is customarily used in conventional dyeing with disperse dyes can be properly added. Next, the thus prepared dye dispersion bath is heated to a temperature of from about 70° C. to about 100° C., and the optical thermoplastic resin plastic lens is dipped in the bath for a period of time that persons skilled in the art can readily determine by routine experimentation in light of the disclosure of this application, especially the Examples. There is thus obtained effectively the desired colored optical thermoplastic resin plastic lens. The dipping time is preferably in the range of from about one minute up to about 2 hours.

The colored plastic lens obtained according to the invention is useful for, for example, spectacle lenses, camera lenses, projector lenses, telescope lenses, and magnifying lenses.

EXAMPLES

Next, the invention will be described below with reference to the Examples, but the invention should not be construed as being limited thereto.

The dyeing density described in the Examples was calculated according to the following equation.

$$[\text{Dyeing density } (\%)]=100-[\text{Transmittance } (\%)]$$

Example 1

In a dyeing tank containing a mixture of 100 parts by weight of pure water and 3.52 parts by weight of BPI Violet (a disperse dye manufactured by Brain Power Incorporated) and 0.24 parts by weight of a surfactant-containing limonene aqueous solution of ORANGE CLEANER 18 (a limonene-containing cleaning agent manufactured by Yasuhara Chemical Co., Ltd.) were added and mixed together. A polycarbonate resin (PANLITE, trade name for polycarbonate resin comprising bisphenol A, manufactured by Teijin Limited) was used as a thermoplastic resin plastic lens. Dyeing of the lens was carried out by dipping the lens into the mixture in the dyeing tank at a dyeing bath temperature of 90° C. for 4 minutes. The dyeing density was measured at a light transmittance of 525 nm. The dyeing density of the lens at 525 nm before dipping in the dyeing tank was 9%. As a result of the use of this method, the dyeing density was found to be 50%.

Dyeing was also carried out under the same conditions except for changing the dyeing time to 10 minutes. As a result, the dyeing density was found to be 74%.

Comparative Example 1

Dyeing of a thermoplastic resin plastic lens was carried out in the same manner as in Example 1, except that the surfactant-containing limonene aqueous solution was not used. The dyeing density of the lens measured at a light transmittance of 525 nm was found to be 9.5%. Since the dyeing density of the lens at 525 nm before dipping in the dyeing tank was 9%, it could be seen that the lens was not substantially dyed by this comparison technique.

Comparative Example 2

Dyeing of a thermoplastic resin plastic lens was carried out in the same manner as in Example 1, except that 0.08 parts by weight of MERRIER TW (manufactured by Meisei Chemical Works, Ltd.), which is a phthalimide/diethyl phthalate-containing carrier, was used in place of the surfactant-containing limonene aqueous solution. In the dyed lens, the lens surface was broken, and the transparency was lost.

Comparative Example 3

Dyeing of a thermoplastic resin plastic lens was carried out in the same manner as in Example 1, except that 0.08 parts by weight of TERYL CARRIER PE-550 (manufactured by Meisei Chemical Works, Ltd.), which is a dichlorobenzene/trichloro-benzene-containing carrier, was used in place of the surfactant-containing limonene aqueous solution. In the dyed lens, the lens surface was broken, and the transparency was lost.

Example 2

To 0.08 parts by weight of ORANGE CLEANER 18 (a limonene-containing cleaning agent manufactured Yasuhara Chemical Co., Ltd.) were added 0.01 parts by weight of NEOPELEX G-15 (soft type sodium dodecylbenzene-sulfonate manufactured by Kao Corporation) as an anionic surfactant and 0.02 parts by weight of NEWCOL 1500 (polyoxyethylene castor oil ether manufactured by Nippon Nyukazai Co., Ltd.) as a nonionic surfactant, in order to prepare a surfactant-containing monocyclic monoterpene aqueous solution. This solution was added to a dyeing tank containing a mixture of 100 parts by weight of pure water and 3.52 parts by weight of BPI Violet (a disperse dye manufactured by Brain Power Incorporated). A polycarbonate resin (PANLITE, trade name for polycarbonate resin comprising bisphenol A, manufactured by Teijin Limited) was used as a thermoplastic resin plastic lens. The lens was subjected to gradient dyeing at a dyeing bath temperature of 90° C. for 10 minutes. As a result, the lens could be dyed in a clear gradient state without invasion of the lens surface. The dyeing density of the central portion of the lens was measured at a light transmittance of 525 nm was found to be 25%.

Example 3

0.6 parts by weight of α-pinene (manufactured by Yasuhara Chemical Co., Ltd.) was mixed with 0.16 parts by weight of PELEX OT-P (a sulfosuccinic acid type anionic surfactant, manufactured by Kao Corporation), 0.16 parts by weight of EMULGEN A-90 (a polyoxyethylene derivative, manufactured by Kao Corporation) and 0.16 parts by weight of NEWCOL 1545 (polyoxyethylene castor oil ether, manufactured by Sanyo Chemical Industries, Ltd.), and the mixture was stirred. The mixed liquid was added to a dyeing tank having a mixture of 100 parts by weight of pure water and 3.52 parts by weight of BPI Violet (a disperse dye manufactured by Brain Power Incorporated), to prepare a dyeing liquid. A polycarbonate resin (PANLITE, trade name for polycarbonate resin comprising bisphenol A, manufactured by Teijin Limited) was used as a thermoplastic resin plastic lens. The lens was dyed at a dyeing bath temperature of 90° C. for 10 minutes. As a result, the lens could be dyed without invasion of the lens surface. The dyeing density of the lens as measured at a light transmittance of 525 nm was found to be 27%.

Example 4

Dyeing was carried out in the same manner as in Example 3, except for changing the α-pinene to α-terpineol. The dyeing density of the lens as measured at a light transmittance of 525 nm was found to be 25%.

Example 5

XYLEX (a commercially available polymer alloy of a polycarbonate resin and a polyester resin manufactured by GE Plastics Japan) was used in place of the polycarbonate resin of Example 1 as the thermoplastic resin plastic lens. Further, BPI Blue (a disperse dye manufactured by Brain Power Incorporated) was used as the dye in place of the BPI Violet (a dye manufactured by Brain Power Incorporated) used in Example 1. The dyeing bath temperature was set at 70° C., and dyeing was otherwise carried out under the same conditions as in Example 1. The dyeing density of the lens measured at a light transmittance of 585 nm was found to be 30%.

Comparative Example 4

Dyeing of a thermoplastic resin plastic lens was carried out in the same manner as in Example 5, except that the surfactant-containing limonene aqueous solution was not used. As a result, the lens was not dyed at all.

What is claimed is:

1. A method of dyeing a thermoplastic resin plastic lens, comprising providing a dyeing liquid comprising one or more disperse dyes and one or more monocyclic monoterpenes at a temperature of from about 70° C. to about 100° C., dipping the lens into the dyeing liquid and carrying out said dipping at said temperature for a period of time in the range of from about one minute up to about 2 hours.

2. The method of claim 1, wherein the thermoplastic resin comprises at least one resin selected from the group consisting of polycarbonate resins, polyolefin resins, polyester resins and polymer alloys comprising said resins.

3. The method of claim 1 or 2, wherein the thermoplastic resin is a polycarbonate resin made from a starting material comprising bisphenol A.

4. The method of claim 1 or 2, wherein the at least one monocyclic monoterpene comprises at least one monocyclic terpene selected from the group consisting of limonene, menthol, terpinene, phellandrene, sylvestrene, pinene and terpineol.

5. The method of claim 3, wherein the at least one monocyclic monoterpene comprises at least one monocyclic terpene selected from the group consisting of limonene, menthol, terpinene, phellandrene, sylvestrene, pinene and terpineol.

6. The method of claim 1 or 2, wherein the at least one monocyclic monoterpene comprises from about 0.001% to about 1% by weight of the dyeing quid.

7. The method of claim 3, wherein the at least one monocyclic monoterpene comprises from about 0.001% to about 1% by weight of the dyeing liquid.

8. The method of claim 5, wherein the at least one monocyclic monoterpene comprises from about 0.001% to about 1% by weight of the dyeing liquid.

9. The method of claim 1 or 2, further comprising adding surfactant to the dyeing liquid to emulsify the at least one monocyclic monoterpene.

10. The method of claim 9, wherein the surfactant is a surfactant having a polyoxyethylene structure.

11. The method of claim 9, wherein the surfactant comprises one or more anionic surfactants selected from the group consisting of alkylbenzenesulfonates, alkylnaphthalenesulfonates, alkylsulfosuccinates, aromatic sulfonic acid-formalin condensates and lauryl sulfonates.

12. The method of claim 9, wherein the surfactant comprises one or more nonionic surfactants selected from the group consisting of polyoxyethylalkyl ethers, alkylamine ethers and polyoxyethylene sorbitan fatty acid esters.

13. A method of dyeing an article formed of a polycarbonate resin made from a starting material comprising bisphenol A, comprising providing a dyeing liquid comprising one or more disperse dyes and one or more monocyclic monoterpenes at a temperature of from about 70° C. to about 100° C., dipping the article into the dyeing liquid and carrying o said dipping at said temperature for a period of time in the range of from about one minute up t about 2 hours.

14. The method of claim 13, wherein the at least one monocyclic monoterpene comprises at least one monocyclic terpene selected from the group consisting of limonene, menthol, terpinene, phellandrene, sylvestrene; pinene and terpineol.

15. The method of claim 13, wherein the at least one monocyclic monoterpene comprises from about 0.001% to about 1% by weight of the dyeing liquid.

16. The method of claim 14, wherein the at least one monocyclic monoterpene comprises from about 0.001% to about 1% by weight of the dyeing liquid.

* * * * *